US006688265B2

(12) United States Patent
Gramkow et al.

(10) Patent No.: US 6,688,265 B2
(45) Date of Patent: Feb. 10, 2004

(54) CAMSHAFT ADJUSTMENT DEVICE FOR AN INTERNAL COMBUSTION ENGINE

(75) Inventors: Thomas Gramkow, Berlin (DE); Kai Lehmann, Ludwigsfelde (DE); Georg Leipner, Bissingen/Teck (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/254,066

(22) Filed: Sep. 24, 2002

(65) Prior Publication Data

US 2003/0062008 A1 Apr. 3, 2003

(30) Foreign Application Priority Data

Sep. 28, 2001 (DE) ..... 101 48 059

(51) Int. Cl.[7] ..... F01L 1/34

(52) U.S. Cl. ..... 123/90.15; 123/90.38; 123/90.18; 123/90.27; 123/195 C

(58) Field of Search ..... 123/90.38, 90.15, 123/90.18, 90.27, 195 C

(56) References Cited

U.S. PATENT DOCUMENTS 6,085,709 A * 7/2000 Freese, V ..... 123/90.38
6,435,154 B1 * 8/2002 Simpson et al. ..... 123/195 C

FOREIGN PATENT DOCUMENTS

DE 196 35 534 A1 10/1997

* cited by examiner

*Primary Examiner*—Thomas Denion
*Assistant Examiner*—Zelalem Eshete
(74) *Attorney, Agent, or Firm*—Klaus J. Bach

(57) ABSTRACT

In a camshaft adjustment device for an internal combustion engine, with at least one sensor unit and one actuator unit, at least two functional units are supported on a common carrier unit and combined into a module for mounting on the internal combustion engine.

10 Claims, 7 Drawing Sheets

CAMSHAFT ADJUSTMENT DEVICE FOR AN INTERNAL COMBUSTION ENGINE

BACKGROUND OF THE INVENTION

The invention relates to a camshaft adjustment device for an internal combustion engine with at least one sensor unit and at least one actuator unit.

Camshaft adjustment devices include at least one sensor, in order to detect the position of the camshaft, and at least one actuator, in order to adjust the camshaft, specifically, they include generally, two sensors and as actuators two lifting magnets or proportional valves.

The sensors and the actuators are mounted, separately from one another, on the cylinder head of an internal combustion engine and are subsequently connected to an internal combustion engine control apparatus via individual plug connections.

Furthermore, DE 196 35 354 A1 discloses a timing device housing cover for an internal combustion engine, which is fastened to one end face of the internal combustion engine and on which are arranged secondary assemblies, such as, in particular, an alternator, refrigerant compressor, power-steering pump and water pump.

It is the object of the invention to provide a camshaft adjustment device which, in particular, can be mounted quickly and simply and can be installed in a space-saving way.

SUMMARY OF THE INVENTION

In a camshaft adjustment device for an internal combustion engine, with at least one sensor unit and one actuator unit, at least two functional units are supported on a common carrier unit, and combined into a module, which can be mounted on the internal combustion engine.

Preferably, all the sensors and all the actuators of the camshaft adjustment device are pre-mounted on a carrier unit. The functional units are preferably combined as a compact subassembly and subsequently jointly positioned and fastened quickly and simply to the internal combustion engine by means of only a few fastening elements.

If the module possesses at least one interface common to the functional units, additional interfaces or plug elements can be avoided and construction space and also the outlay for mounting can be saved. Furthermore, incorrect mountings due to mistaken plug connections can be avoided.

In an advantageous embodiment of the invention, the lines between the common interface and the functional units are integrated in a supply unit, with the result that further expenses for mounting and further construction space can be saved. The lines may be integrated in the supply unit by means of various methods, which appear to be appropriate to a person skilled in the art and also be formed by various components. The lines may be formed, for example, by current leads placed or cast in conduits, by punched grids, by flexible foils or by means produced by what is known as the MID technique (Molded Interconnect Devices technique). The functional units may in this case be connected to the supply unit non-positively, positively and/or in a materially integral manner, releasably or unreleasably, for example, by means of a welded joint, a clamp connection, etc. By means of punched grids, flexible foils or other corresponding means which seem suitable to a person skilled in the art, a large number of lines can advantageously be provided in a space-saving way with one or with only a few components and the outlay for mounting can be reduced.

If the supply unit includes plugs for the functional units for the connection to the common interface, these can be mounted quickly and simply and, in the event of damage the unit can be easily exchanged.

If the supply unit is produced at least partially from plastic, the lines and other components, which seem appropriate to a person skilled in the art can also be molded in a simple way into the supply unit. Additional mounting steps and fastening elements can thus be avoided and an advantageous protection of the molded-in components can be achieved. Furthermore, functional elements, such as, for example, plug-in stations, latching connections, etc., can also be integrally formed in a simple and cost-effective manner and a lightweight subassembly can be provided.

If, moreover, the supply unit serves as an electrical insulator, additional electrical insulators, for example covers of punched grids, etc., can be saved.

The supply unit may be produced as a unit separate from the carrier unit or it may advantageously be produced at least partially integrally with the carrier unit with the result that, again, additional components, construction space and outlays for mounting can be saved.

The functional units may be fastened to the carrier unit by means of various non-positive, positive and/or materially integral connections which seem appropriate to a person skilled in the art, such as, for example, by means of screw connections, latch connections, etc. If the carrier unit is injection-molded around at least one functional unit or, particularly advantageously, all the functional units, a particularly compact unit with advantageously protected functional units can be achieved. Fastening elements and outlay in terms of mounting for the functional units can be avoided in this case.

Furthermore, insertion elements, construction space and mounting outlay can be saved if the data transmission lines exit with the power supply lines, in the common interface. The data transmission lines are in this case integrated preferably into the supply unit.

In a further embodiment of the invention, the carrier unit supports at least one control and/or regulating unit specifically for controlling the position of the camshaft. Control and regulation, which are particularly insensitive to faults, can be achieved by means of short data lines. Furthermore, it is possible to achieve a separately mountable independent subassembly which can be checked for proper functioning and which, in particular, can be produced largely independently of an internal combustion engine control unit. The control and regulating unit integrated in the module can be designed specifically with a view to the operation of the unit. Power outlets at the internal combustion engine control unit can be avoided and construction space can be saved.

If the sensor unit and the actuator unit are oriented in the same direction on the carrier unit, that is, preferably in the axial direction of the camshaft, deviations at the functional units can be avoided and construction space can be saved. Furthermore, a plane closing-off surface of the carrier unit with respect to the internal combustion engine can be achieved in a simple way, with the result that a structurally simple and cost-effective carrier unit can be provided.

In a further embodiment, the carrier unit serves as a cover covering an inner space of the internal combustion engine with the result that there is no need for an additional cover. If the closing-off interface of the carrier unit and the internal combustion engine is plane, the latter can be sealed off simply and reliably.

The invention will become more readily apparent from the following description of exemplary embodiments thereof. The description and the claims contain numerous features in combination. A person skilled in the art will expediently also consider the features individually and combine them into appropriate further combinations.

DESCRIPTION OF PREFERRED EMBODIMENTS

Figure 1:
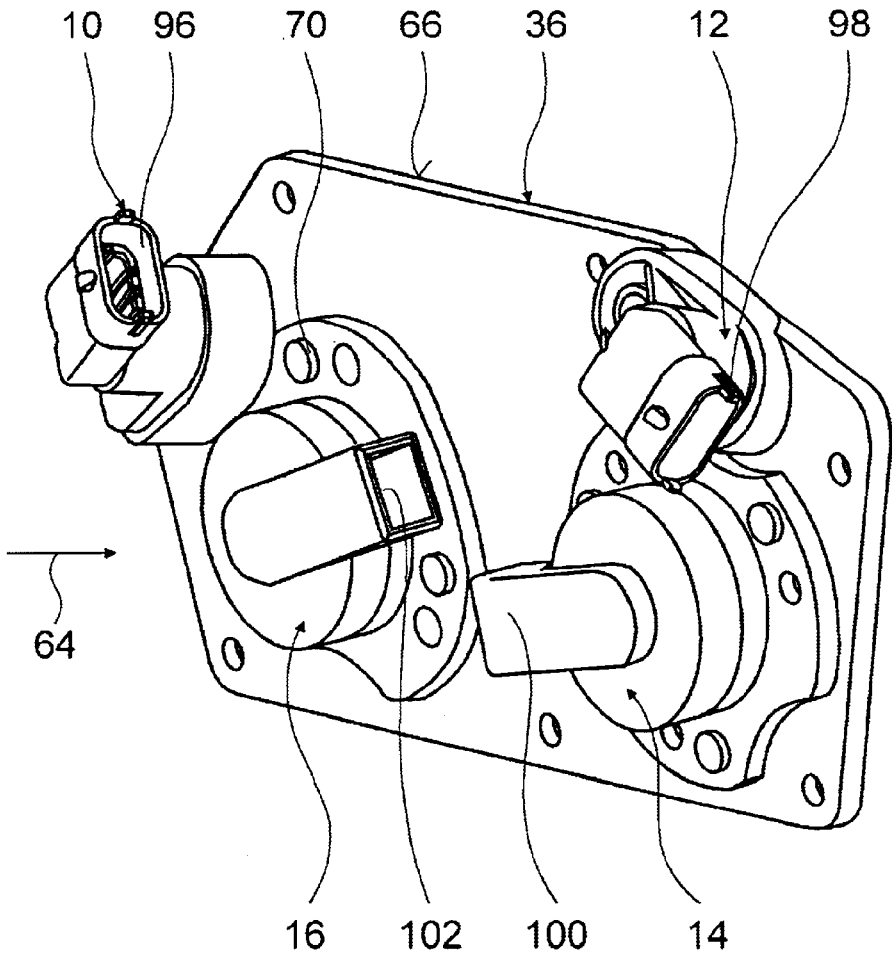
FIG. 1 shows a camshaft adjustment device.
Figure 2:
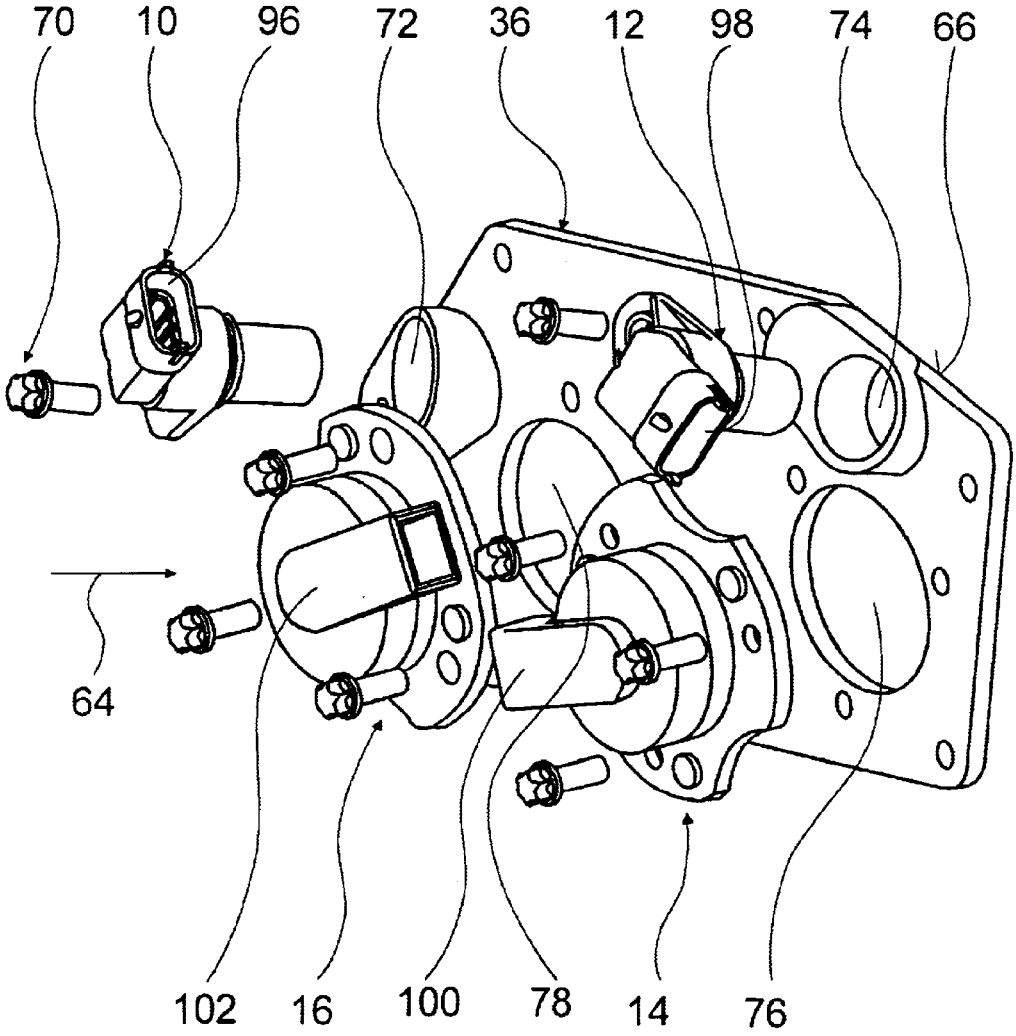
FIG. 2 shows the camshaft adjustment device of FIG. 1 in an exploded illustration.

FIGS. 1 and 2 show a camshaft adjustment device for an internal combustion engine, which is not illustrated in detail. The camshaft adjustment device includes two sensor units 10, 12 and two actuator units 14, 16 formed by lifting magnets. All the functional units 10, 12, 14, 16, specifically both sensor units 10, 12 and both actuator units 14, 16 are supported on a common carrier unit 36 in the form of an aluminum plate and combined into a module so that they can be mounted jointly onto the internal combustion engine.

The functional units 10, 12, 14, 16 are firmly screwed to the carrier unit 36 by means of screws 70, the sensor units 10, 12 and the actuator units 14, 16 being oriented, in the mounted state on the carrier unit 36, in the axial direction 64 with respect to a camshaft of the internal combustion engine, not illustrated. During the mounting of the functional units 10, 12, 14, 16, the functional units are inserted in the direction 64 into openings 72, 74, 76, 78 of the carrier unit 36 (FIG. 2).

Each functional unit 10, 12, 14, 16 is designed with a separate plug 96, 98, 100, 102, via which plugs the functional units 10, 12, 14, 16 can be connected to an internal combustion engine control unit which is not illustrated in detail.

The carrier unit 36 is provided with respect to the internal combustion engine, with a plane interface surface 66, and serves as a cover of the internal combustion engine to close an inner space of the internal combustion engine relative to the outside at a passage opening.

FIGS. 3 and 4 and FIGS. 5, 6, and 7 illustrate alternative camshaft adjustment devices. Components, which remain essentially the same, are indicated by the same reference symbols. Furthermore, as regards features and functions, which remain the same, reference may be made to the description of the exemplary embodiment shown in FIGS. 1 and 2. The following description is restricted essentially to the differences from the exemplary embodiment shown in FIGS. 1 and 2.

Figure 3:
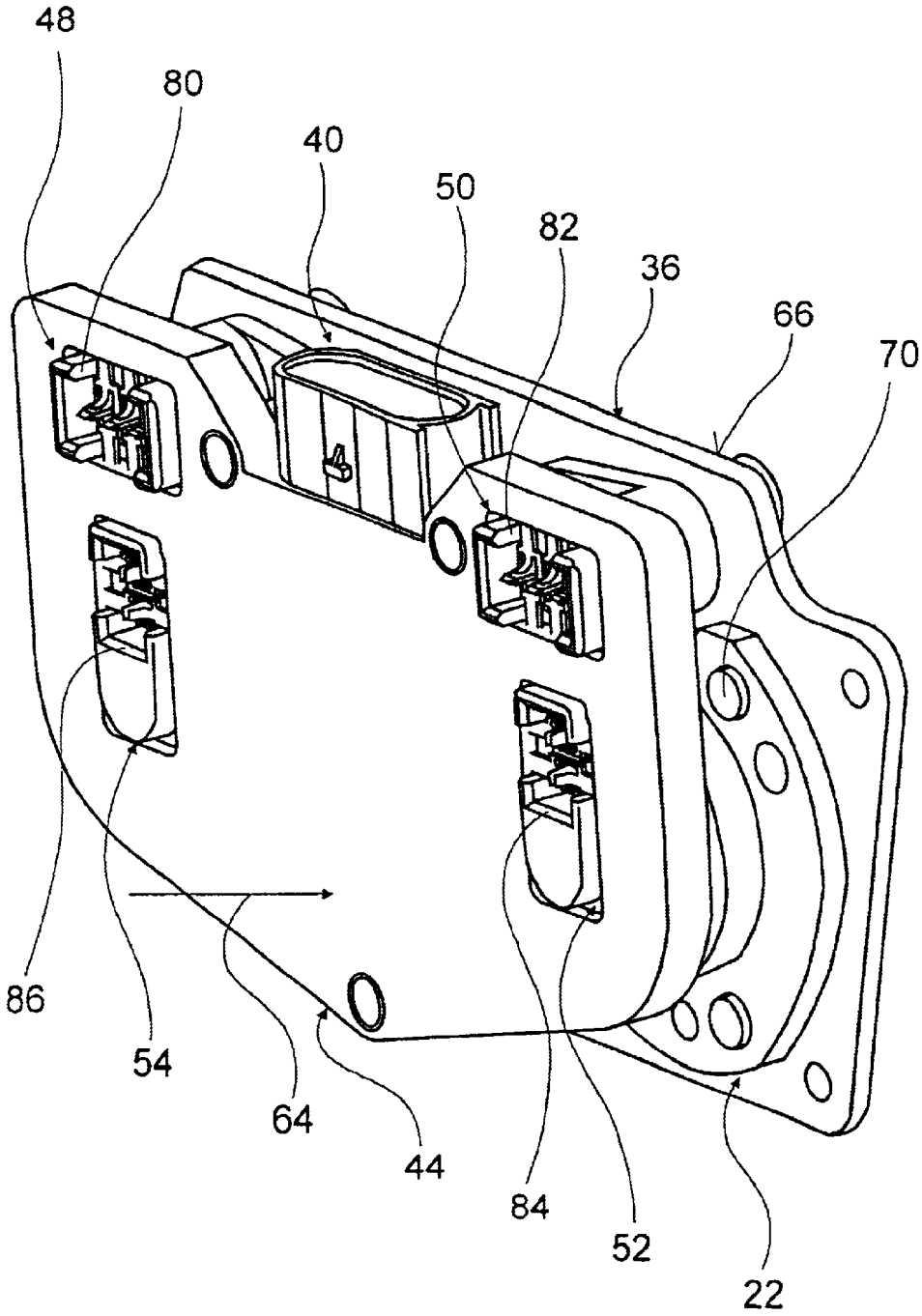
FIG. 3 shows an alternative camshaft adjustment device to that of FIG. 1, with a supply unit.
Figure 4:
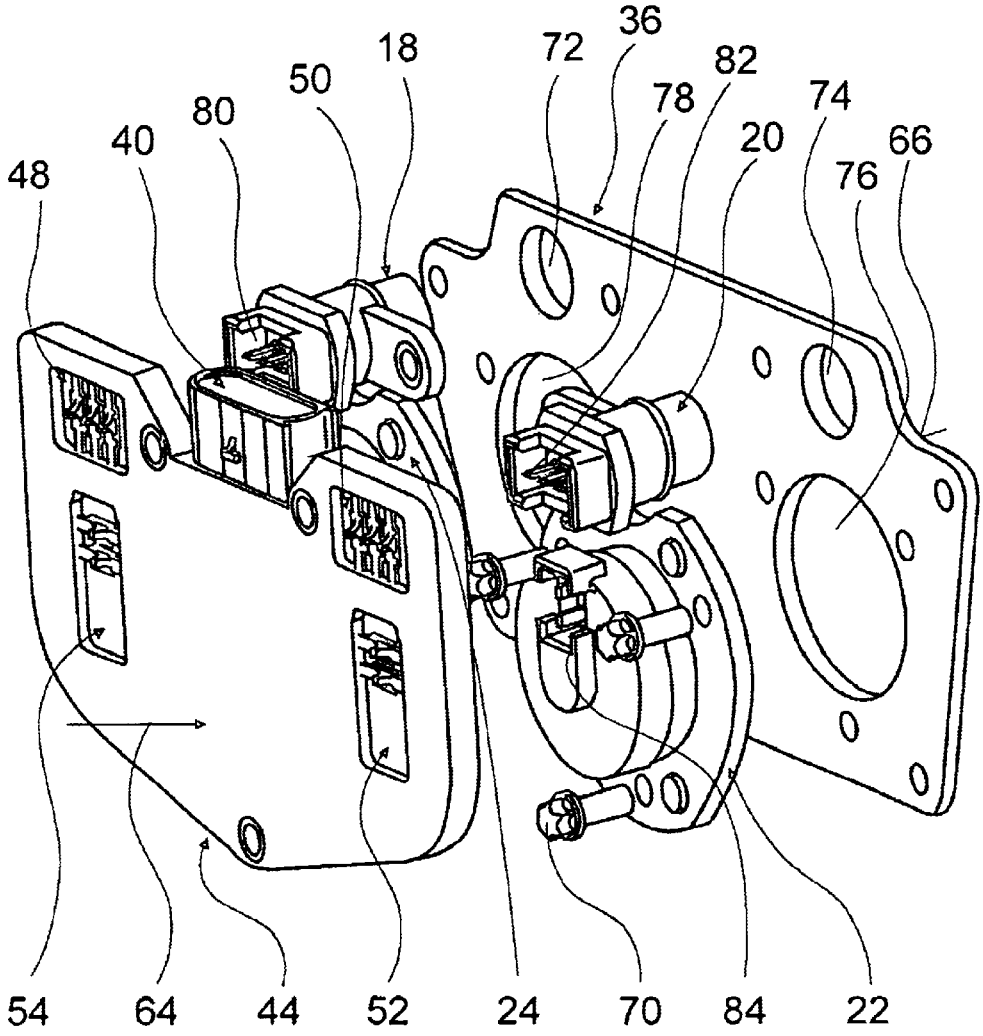
FIG. 4 shows the camshaft adjustment device of FIG. 3 in an exploded illustration.

The camshaft adjustment device according to FIGS. 3 and 4 includes four functional units 18, 20, 22, 24 fastened to a common carrier unit 36 and combined into a module. The functional units are specifically two sensor units 18, 20 and two actuator units 22, 24, which are lifting magnets. The module has a common interfacing structure 40 for the functional units 18, 20, 22, 24.

The interfacing structure 40 designed as a central plug is integrally formed onto a plate-shaped supply unit 44 of a plastic material. A punched grid, not illustrated in detail, is injection-molded into the supply unit 44 and forms the power and data transmission lines between the common interface structure 40 and the functional units 18, 20, 22, 24. The supply unit 44 serves as an electrical insulator of the punched grid relative to the outside.

The functional units 18, 20, 22, 24 each include a plug 80, 82, 84, 86, which plugs point in a direction opposite to a mounting direction 64 in which the functional units 18, 20, 22, 24 are mounted to the carrier unit 36 (FIG. 4). The functional units 18, 20, 22, 24 can be connected to the interface structure 40 via the plugs 48, 50, 52, 54, 80, 82, 84, 86.

Figure 5:
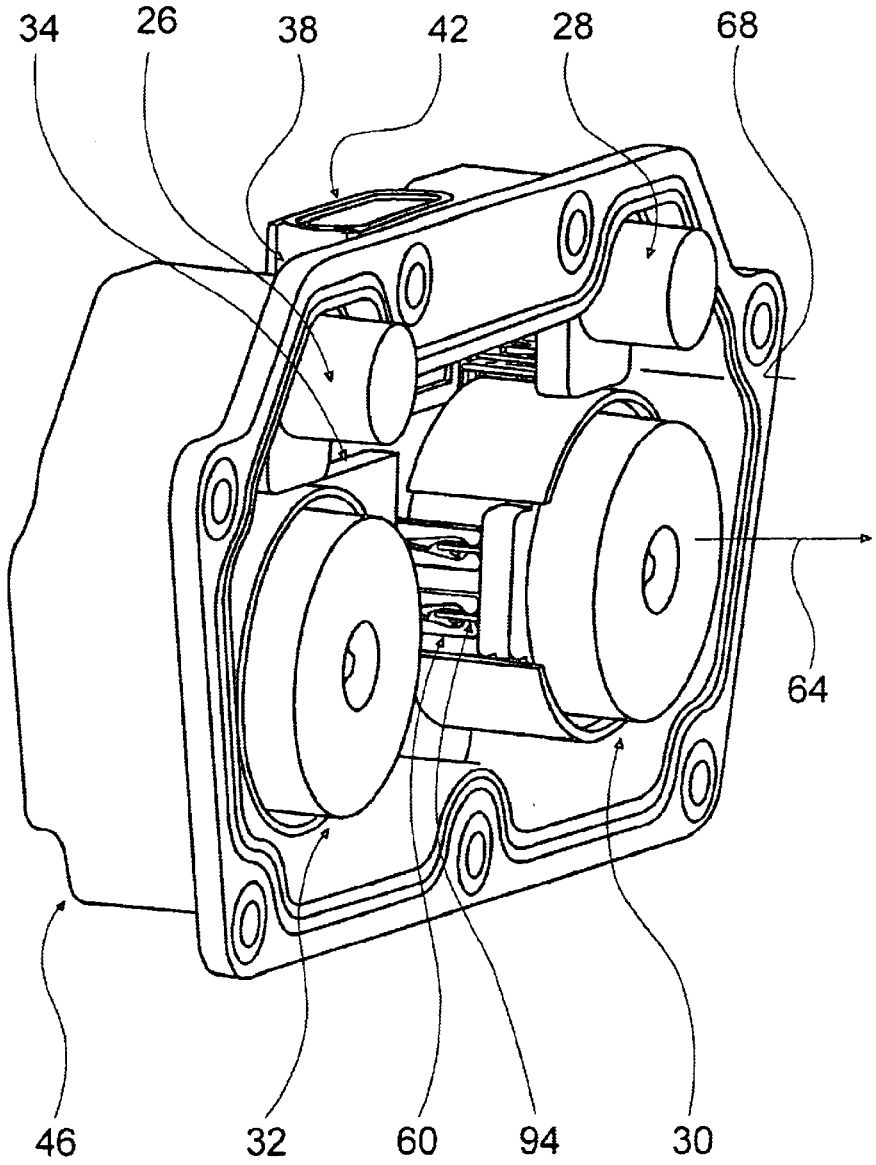
FIG. 5 shows, from inside, an alternative camshaft adjustment device to that of FIG. 2, with a carrier unit and supply unit consisting of a single piece.
Figure 6:
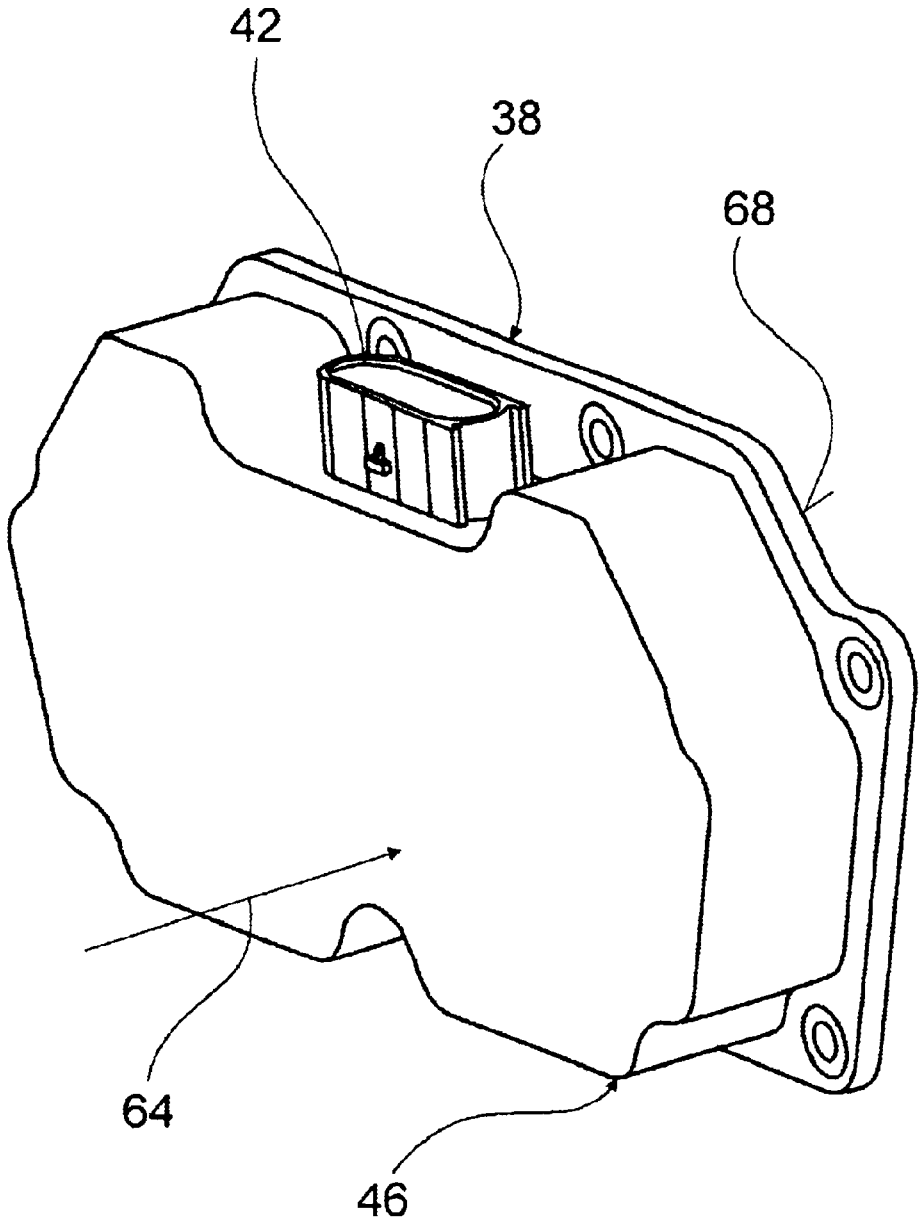
FIG. 6 shows the outside the camshaft adjustment device of FIG. 5.
Figure 7:
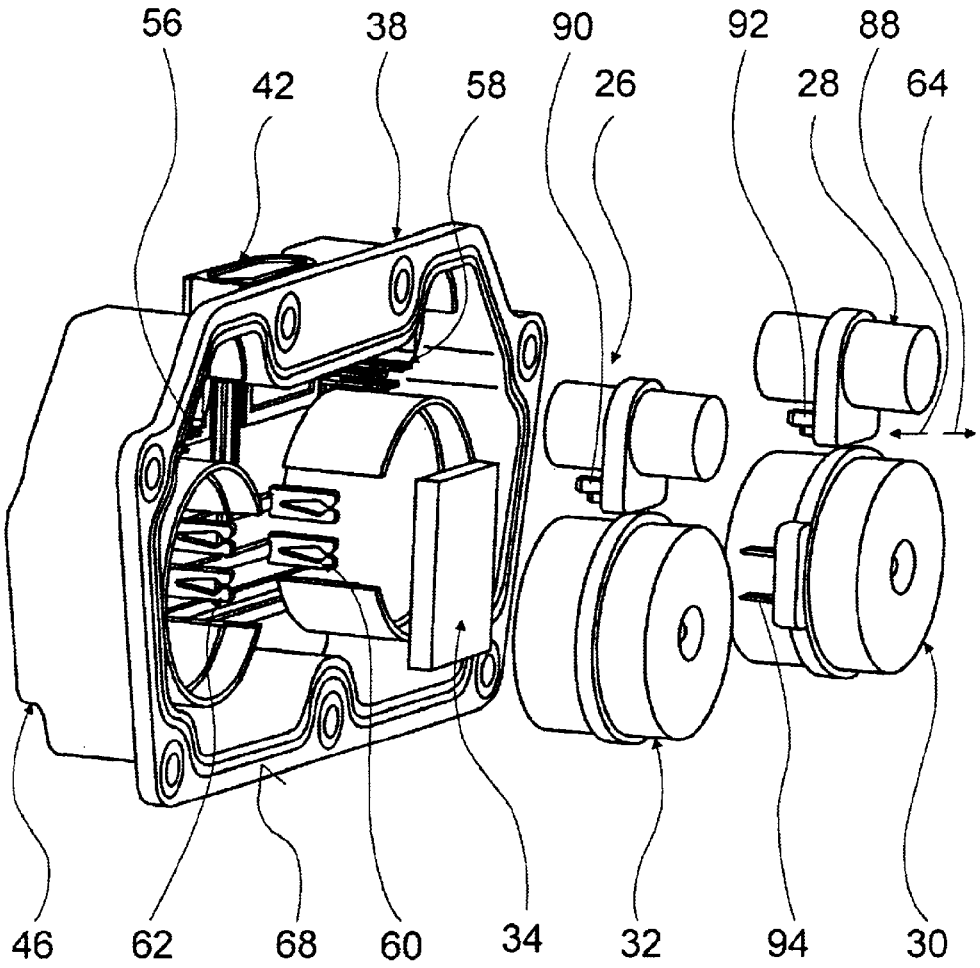
FIG. 7 shows the camshaft adjustment device of FIG. 5 in an exploded illustration.

In the camshaft adjustment device illustrated in FIGS. 5, 6, and 7, a supply unit 46 and a carrier unit 38 are formed integrally as a single unit. The carrier unit 38 and the supply unit 46 consist of plastic. The camshaft adjustment device possesses five functional units 26, 28, 30, 32, 34 fastened to the carrier unit 38 via an ultrasonic welding method and combined into a module, the functional units being specifically two sensor units 26, 28, two actuator units 30, 32 in the form of lifting magnets and a control and regulating unit 34.

Molded into the supply unit 46 is a punched grid, via which the functional units 26, 28, 30, 32, 334 are connected to an interface structure 42 in the form of a central plug, which is integrally formed onto the supply unit 46 or carrier unit 38. Furthermore, the sensor units 26, 28 and the actuator units 30, 32 are connected via the punched grid to the control and regulating unit 34 which controls the position of a camshaft of the internal combustion engine, not illustrated in detail. The module can be connected to an internal combustion engine control apparatus, not illustrated, via the interface structure 42 to which power and data lines of the supply unit 46 formed by the punched grid extend.

The sensor units 26, 28 and the actuator units 30, 32 are oriented in the carrier unit 38 in the axial direction 64 of the camshaft. The supply unit 46 includes plugs 56, 58, 60, 62 for the functional units 26, 28, 30, 32, 34 and a plug for the connection of the control and regulating unit 34, not illustrated. During mounting, the functional units 26, 28 30, 32, 34 are plugged into the carrier unit 38 in the direction 88, and, by means of plugs 90, 92, 94, 62, 90, 92, 94 pointing in the direction 88, are connected to the plugs 56, 58, 60, 62 of the supply unit 46. Also, the functional units 26, 28, 30, 32, 34 are connected to the punched grid via the plugs 56, 58, 60, 62, 90, 92, 94. The functional units 26, 28, 30, 32 are subsequently welded ultrasonically to the carrier unit 38.

The carrier unit 38 has, with respect to the internal combustion engine, a plane interface surface 68 and, serves as a cover of the internal combustion engine and closes an inner space of the internal combustion engine relative to the outside at a passage opening.

What is claimed is:

1. A camshaft adjustment device for an internal combustion engine, said adjustment device including at least one sensor unit and one actuator unit and at least two functional units combined into a module and supported on a common carrier unit said carrier unit being mounted on said internal combustion engine, said module having at least one interface structure common to said functional units, and a supply unit including plugs for connection of the functional units to said common interface structure, said common interface structure and said functional units being interconnected by communication lines which are integrated in said supply unit.

2. A camshaft adjustment device according to claim 1, wherein said supply unit consists at least partially of a plastic material.

3. A camshaft adjustment device according to claim 2, wherein said supply unit serves as an electrical insulator.

4. A camshaft adjustment device according to claim 1, wherein said supply unit is integrally formed with said carrier unit so as to form a single piece.

5. A camshaft adjustment device according to claim 2, wherein said carrier unit is injection molded around at least one functional unit.

6. A camshaft adjustment device according to claim 1, wherein data lines as well as power supply lines extend to said common interface.

7. A camshaft adjustment device according to claim 1, wherein said carrier unit carries at least one of a control and regulating unit.

8. A camshaft adjustment device according to claim 1, wherein said sensor unit and said actuator unit are oriented in the same direction on the carrier unit.

9. A camshaft adjustment device according to claim 1, wherein said carrier unit has a plane interface surface with respect to the internal combustion engine.

10. A camshaft adjustment device according to claim 1, wherein said carrier unit serves as a cover of the internal combustion engine and closes an inner space of the internal combustion engine relative to the outside at a passage opening to close said passage opening.

* * * * *